US006213583B1

(12) United States Patent
Therien

(10) Patent No.: US 6,213,583 B1
(45) Date of Patent: Apr. 10, 2001

(54) TAPERED SCREW SPITTOOM SYSTEM FOR WASTE INKJET INK

(75) Inventor: Patrick J Therien, Battle Ground, WA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/071,330

(22) Filed: Apr. 30, 1998

(51) Int. Cl.[7] ..... B41J 2/165
(52) U.S. Cl. ..... 347/36; 347/35
(58) Field of Search ..... 347/36, 33, 29, 347/35

(56) References Cited

U.S. PATENT DOCUMENTS

| | | | | |
|---|---|---|---|---|
| 4,935,753 | | 6/1990 | Lehmann et al. | 347/33 |
| 5,617,124 | * | 4/1997 | Taylor et al. | 347/35 |

OTHER PUBLICATIONS

Webster's Ninth New Collegiate Dictionary, p. 267, 1983.*
Commonly–owned, co–pending U.S. Pat. application Ser. No. 08/509,070, filed Jul. 31, 1995, entitled "Translationally Moveable Absorbent Spitting Station for Inkjet Printheads".
Commonly–owned, co–pending U.S. Pat. application No. 09/007,446, filed Jan. 15, 1998, entitled "Storage and Spittoon System for Waste Inkjet Ink".

* cited by examiner

*Primary Examiner*—N. Le
*Assistant Examiner*—Shih-wen Hsieh
(74) *Attorney, Agent, or Firm*—Flory L. Martin

(57) ABSTRACT

A tapered screw spittoon system is provided for an inkjet printing mechanism to handle waste inkjet ink residue that has been spit from an inkjet printhead during a nozzle clearing or "spitting" routine. The spittoon system has a cylindrical reservoir with a tapered screw rotatably mounted therein. The reservoir defines an entranceway opening to receive the ink residue, which then lands on a spit region of the screw. The screw has a tapered shaft which increases in diameter from the entranceway opening toward an exit opening defined by the reservoir wall at a remote location. When rotated, the tapered screw transports the ink residue from the spit region toward the exit opening. During transport, the ink residue is compacted between the screw shaft and the reservoir, and is squeezed out of the reservoir through the exit opening for permanent storage in a container surrounding the reservoir. Methods of purging ink residue from an inkjet printhead, along with an inkjet printing mechanism having such a tapered screw spittoon system, are also provided.

25 Claims, 3 Drawing Sheets

TAPERED SCREW SPITTOOM SYSTEM FOR WASTE INKJET INK

FIELD OF THE INVENTION

The present invention relates generally to inkjet printing mechanisms, and more particularly to a tapered screw spittoon system for handling waste inkjet ink that has been spit from an inkjet printhead during a nozzle clearing, purging or "spitting" routine.

BACKGROUND OF THE INVENTION

Inkjet printing mechanisms use cartridges, often called "pens," which eject drops of liquid colorant, referred to generally herein as "ink," onto a page. Each pen has a printhead formed with very small nozzles through which the ink drops are fired. To print an image, the printhead is propelled back and forth across the page, ejecting drops of ink in a desired pattern as it moves. The particular ink ejection mechanism within the printhead may take on a variety of different forms known to those skilled in the art, such as those using piezo-electric or thermal printhead technology. For instance, two earlier thermal ink ejection mechanisms are shown in U.S. Pat. Nos. 5,278,584 and 4,683,481. In a thermal system, a barrier layer containing ink channels and vaporization chambers is located between a nozzle orifice plate and a substrate layer. This substrate layer typically contains linear arrays of heater elements, such as resistors, which are energized to heat ink within the vaporization chambers. Upon heating, an ink droplet is ejected from a nozzle associated with the energized resistor. By selectively energizing the resistors as the printhead moves across the page, the ink is expelled in a pattern on the print media to form a desired image (e.g., picture, chart or text).

To clean and protect the printhead, typically a "service station" mechanism is supported by the printer chassis so the printhead can be moved over the station for maintenance. For storage, or during non-printing periods, the service stations usually include a capping system which substantially seals the printhead nozzles from contaminants and drying. Some caps are also designed to facilitate priming, such as by being connected to a pumping unit that draws a vacuum on the printhead. During operation, clogs in the printhead are periodically cleared by firing a number of drops of ink through each of the nozzles in a process known as "spitting," with the waste ink being collected in a "spittoon" reservoir portion of the service station. After spitting, uncapping, or occasionally during printing, most service stations have an elastomeric wiper that wipes the printhead surface to remove ink residue, as well as any paper dust or other debris that has collected on the printhead. The wiping action is usually achieved through relative motion of the printhead and wiper, for instance by moving the printhead across the wiper, by moving the wiper across the printhead, or by moving both the printhead and the wiper.

As the inkjet industry investigates new printhead designs, one trend is toward using a "snapper" reservoir system where permanent or semi-permanent printheads are used and a reservoir carrying a fresh ink supply is snapped into place on the printhead. Another new design uses permanent or semi-permanent printheads in what is known in the industry as an "off-axis" printer. In an off-axis system, the printheads carry only a small ink supply across the printzone, with this supply being replenished through tubing that delivers ink from an "off-axis" stationary reservoir placed at a remote stationary location within the printer. Narrower printheads may lead to a narrower printing mechanism, which has a smaller "footprint," so less desktop space is needed to house the printing mechanism during use. Narrower printheads are usually smaller and lighter, so smaller carriages, bearings, and drive motors may be used, leading to a more economical printing unit for consumers.

These snapper and off-axis inkjet systems are described in contrast with what is known as a "replaceable cartridge" system, which supply a disposable printhead with the ink supply in an inkjet cartridge, so when the reservoir is emptied, the entire cartridge including the printhead is replaced. A replaceable cartridge system assures the customer has a fresh, new printhead each time the ink supply is replaced. Some replaceable cartridges are monochrome (single color), for instance, carrying only black ink, while other cartridges are multi-color, typically carrying cyan, magenta and yellow inks. Some printing mechanisms use four monochrome cartridges, while others use a black monochrome cartridge in combination with a tri-color cartridge.

To improve the clarity and contrast of the printed image, recent research has focused on improving the ink itself. To provide quicker, more waterfast printing with darker blacks and more vivid colors, pigment-based inks have been developed. These pigment-based inks have a higher solid content than the earlier dye-based inks, which results in a higher optical density for the new inks. Both types of ink dry quickly, which allows inkjet printing mechanisms to form high quality images on readily available and economical plain paper, as well as on recently developed specialty coated papers, transparencies, fabric and other media. However, the combination of small nozzles and quick-drying ink leaves the printheads susceptible to clogging, not only from dried ink or minute dust particles, such as paper fibers, but also from the solids within the new inks themselves.

When spitting these new pigment-based inks onto the flat bottom of a conventional spittoon, over a period of time the rapidly solidifying waste ink grew into a stalagmite of ink residue. Eventually, in prototype units, the ink residue stalagmite grew to contact the printhead, which then either could interfere with printhead movement, print quality, or contribute to clogging the nozzles. Indeed, these stalagmites even formed ink deposits along the sides of the entranceway of prototype narrow spittoons, and eventually grew to meet one another and totally clog the entrance to the spittoon. To avoid this phenomenon, conventional spittoons had to be wide enough to handle these high solid content inks. This extra width increased the overall printer width, which then defeated the narrowing advantages realized by using an off-axis printhead system.

A ferris wheel spittoon system was disclosed in U.S. Pat. No. 5,617,124, currently assigned to the present assignee, the Hewlett-Packard Company. This system proposed an elastomeric ferris wheel as a spit surface. Ink residue was removed from the wheel with a rigid plastic scraper that was oriented along a radial of the wheel so the scraper edge approached the spitting surface at a substantially perpendicular angle. The scraper was located a short distance from the surface of the wheel, so it unfortunately could not completely clean the spitting surface. Furthermore, by locating the scraper a distance from the spit surface, the scraper was ineffective in removing any liquid ink residue from the wheel. This earlier ferris wheel spittoon system failed to provide for adequate storage of the ink residue after removal from the ferris wheel during the desired lifespan of a printer. One adaptation of the ferris wheel spittoon used a plastic scraper to remove the ink residue from the wheel in a spaghetti-like string that was packed in a storage bucket. Unfortunately, this wheel spittoon, scraper and bucket system does not lend itself well to height reduction. Thus, it would be desirable to have a spittoon system which defeats ink residue stalagmite build-up, and provides a low-profile ink residue storage system for the lifespan of the inkjet printing unit.

SUMMARY OF THE INVENTION

According to one aspect of the present invention, a spittoon system is provided for handling ink residue spit from an inkjet printhead in an inkjet printing mechanism. The spittoon system includes a reservoir having a first end and an opposing second end. The reservoir defines an entranceway opening adjacent to the first end for receiving ink residue spit from the inkjet printhead. The reservoir also defines an ink exit opening that is located remote from the first end. A tapered screw member is rotatably mounted inside the cylindrical reservoir. The tapered screw member has a tapered shaft which increases in diameter along the length of the screw member from the first end of the reservoir toward the second end of the reservoir. The spittoon system also has a rotating device that selectively rotates the tapered screw member to transport ink residue received through the entranceway opening, and that squeezes the ink residue out of the reservoir through the ink exit opening.

According to another aspect of the present invention, a spittoon system is provided for handling ink residue spit from an inkjet printhead in an inkjet printing mechanism. The spittoon system has a reservoir with a wall having an interior surface that defines a collection chamber. The collection chamber has a first end and an opposing second end. The reservoir defines an entranceway opening adjacent to the first end for receiving ink residue spit from the inkjet printhead, and the reservoir also defines an ink exit opening remote from the first end. An active member is moveably mounted inside the cylindrical reservoir to define a void between the active member and the interior surface of the reservoir wall. This void decreases in cross sectional volume from the first end of the reservoir toward the second end of the reservoir. The spittoon system also has an activator device that selectively moves the active member to transport ink residue received through the entranceway opening through the void to the ink exit opening. The ink residue is compacted during transport through the decreasing in cross sectional volume of the void and squeezed out of the reservoir through the ink exit opening.

According to a further aspect of the present invention, a method of purging ink residue from an inkjet printhead in an inkjet printing mechanism is provided. This method includes the steps of spitting ink residue from the printhead onto a spit region of a compaction member and transporting the ink residue from the spit region to a second location. During the transporting step, in a compacting step the ink residue is compacted with the compaction member. The method also includes the step of expelling the compacted ink residue into a storage container at the second location.

According to a still another aspect of the present invention, method is provided of purging ink residue from an inkjet printhead in an inkjet printing mechanism. This method includes the step of spitting ink residue from the printhead onto a spit region of a spiral member rotationally mounted within a reservoir. In a transporting step, the spit ink residue from the spit region is transported to a second location along a spiral path within the reservoir. The method also includes the step of expelling the ink residue into a storage container at the second location.

According to a further aspect of the present invention, an inkjet printing mechanism may be provided with a spittoon system for handling waste inkjet ink as described above.

An overall goal of the present invention is to provide an inkjet printing mechanism which prints sharp vivid images over the life of the printhead and the printing mechanism.

Still another goal of the present invention is to provide a spittoon system that efficiently removes the waste ink residue from a spitting region and then stores this residue over the expected lifespan of an inkjet printing mechanism.

Another goal of the present invention is to provide a long-life spittoon system for receiving ink spit from printheads in an inkjet printing mechanism to provide consumers with a reliable, robust inkjet printing unit.

DETAILED DESCRIPTION OF A PREFERRED EMBODIMENT

Figure 1:
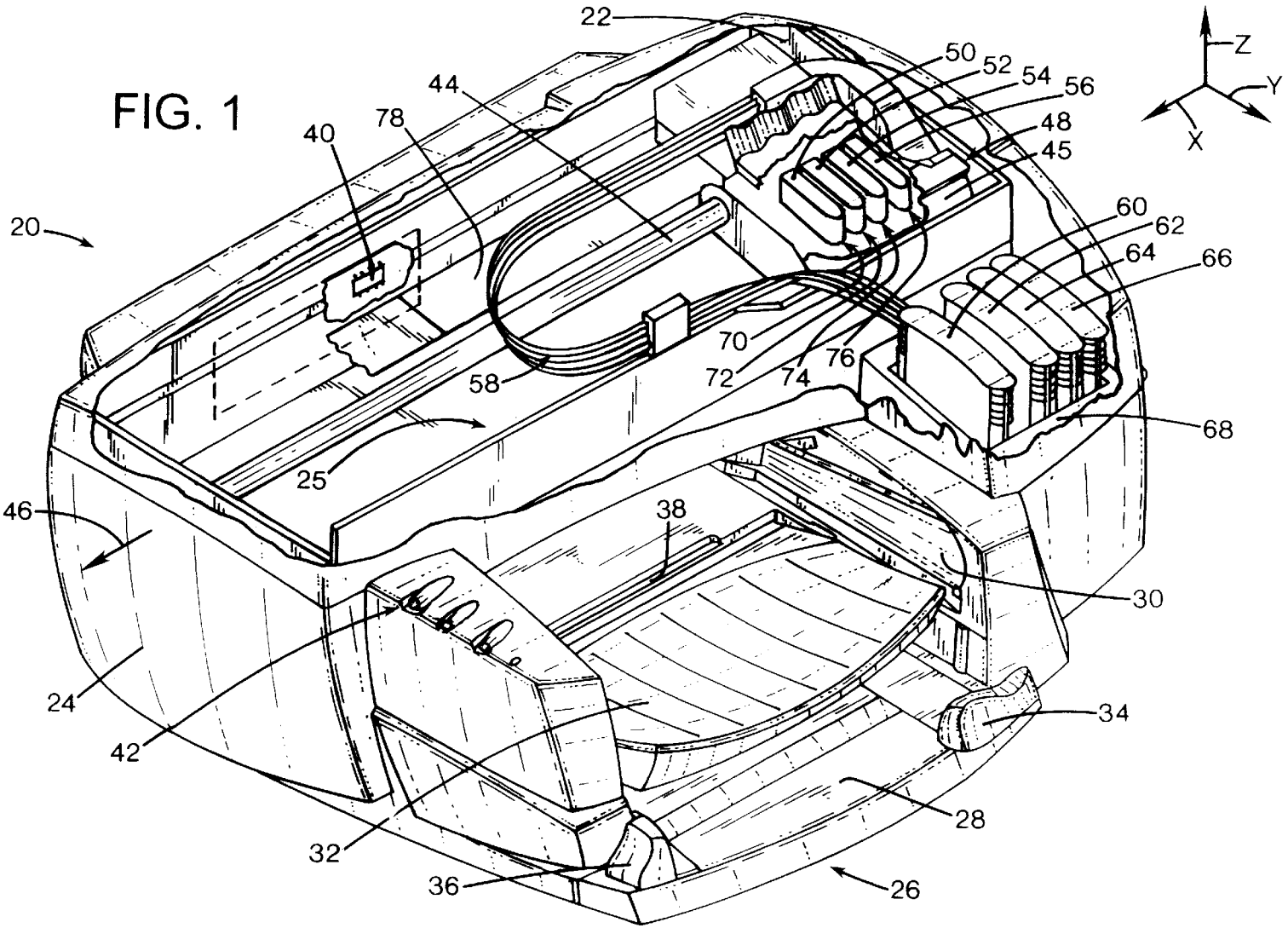
FIG. 1 is a perspective view of one form of an inkjet printing mechanism, here, inkjet printer, including a printhead service station having one form of a tapered screw spittoon system of the present invention for servicing inkjet printheads.

FIG. 1 illustrates an embodiment of an inkjet printing mechanism, here shown as an "off-axis" inkjet printer 20, constructed in accordance with the present invention, which may be used for printing for business reports, correspondence, desktop publishing, and the like, in an industrial, office, home or other environment. A variety of inkjet printing mechanisms are commercially available. For instance, some of the printing mechanisms that may embody the present invention include plotters, portable printing units, copiers, cameras, video printers, and facsimile machines, to name a few, as well as various combination devices, such as a combination facsimile/printer. For convenience the concepts of the present invention are illustrated in the environment of an inkjet printer 20.

While it is apparent that the printer components may vary from model to model, the typical inkjet printer 20 includes a frame or chassis 22 surrounded by a housing, casing or enclosure 24, typically of a plastic material. Sheets of print media are fed through a printzone 25 by a media handling system 26. The print media may be any type of suitable sheet material, such as paper, card-stock, transparencies, photographic paper, fabric, mylar, and the like, but for convenience, the illustrated embodiment is described using paper as the print medium. The media handling system 26 has a feed tray 28 for storing sheets of paper before printing. A series of conventional paper drive rollers driven by a stepper motor and drive gear assembly (not shown), may be used to move the print media from the input supply tray 28, through the printzone 25, and after printing, onto a pair of extended output drying wing members 30, shown in a retracted or rest position in FIG. 1. The wings 30 momentarily hold a newly printed sheet above any previously printed sheets still drying in an output tray portion 32, then the wings 30 retract to the sides to drop the newly printed sheet into the output tray 32. The media handling system 26 may include a series of adjustment mechanisms for accommodating different sizes of print media, including letter, legal, A-4, envelopes, etc., such as a sliding length adjustment lever 34, a sliding width adjustment lever 36, and an envelope feed port 38.

The printer 20 also has a printer controller, illustrated schematically as a microprocessor 40, that receives instructions from a host device, typically a computer, such as a personal computer (not shown). Indeed, many of the printer controller functions may be performed by the host computer, by the electronics on board the printer, or by interactions therebetween. As used herein, the term "printer controller 40" encompasses these functions, whether performed by the host computer, the printer, an intermediary device therebetween, or by a combined interaction of such elements. The printer controller 40 may also operate in response to user inputs provided through a key pad 42 located on the exterior of the casing 24. A monitor coupled to the computer host may be used to display visual information to an operator, such as the printer status or a particular program being run on the host computer. Personal computers, their input devices, such as a keyboard and/or a mouse device, and monitors are all well known to those skilled in the art.

A carriage guide rod 44 is supported by the chassis 22 to slidably support an off-axis inkjet pen carriage system 45 for travel back and forth across the printzone 25 along a scanning axis 46. The carriage 45 is also propelled along guide rod 44 into a servicing region, as indicated generally by arrow 48, located within the interior of the housing 24. A conventional carriage drive gear and DC (direct current) motor assembly may be coupled to drive an endless belt (not shown), which may be secured in a conventional manner to the carriage 45, with the DC motor operating in response to control signals received from the controller 40 to incrementally advance the carriage 45 along guide rod 44 in response to rotation of the DC motor. To provide carriage positional feedback information to printer controller 40, a conventional encoder strip may extend along the length of the printzone 25 and over the service station area 48, with a conventional optical encoder reader being mounted on the back surface of printhead carriage 45 to read positional information provided by the encoder strip. The manner of providing positional feedback information via an encoder strip reader may be accomplished in a variety of different ways known to those skilled in the art.

Figure 2:
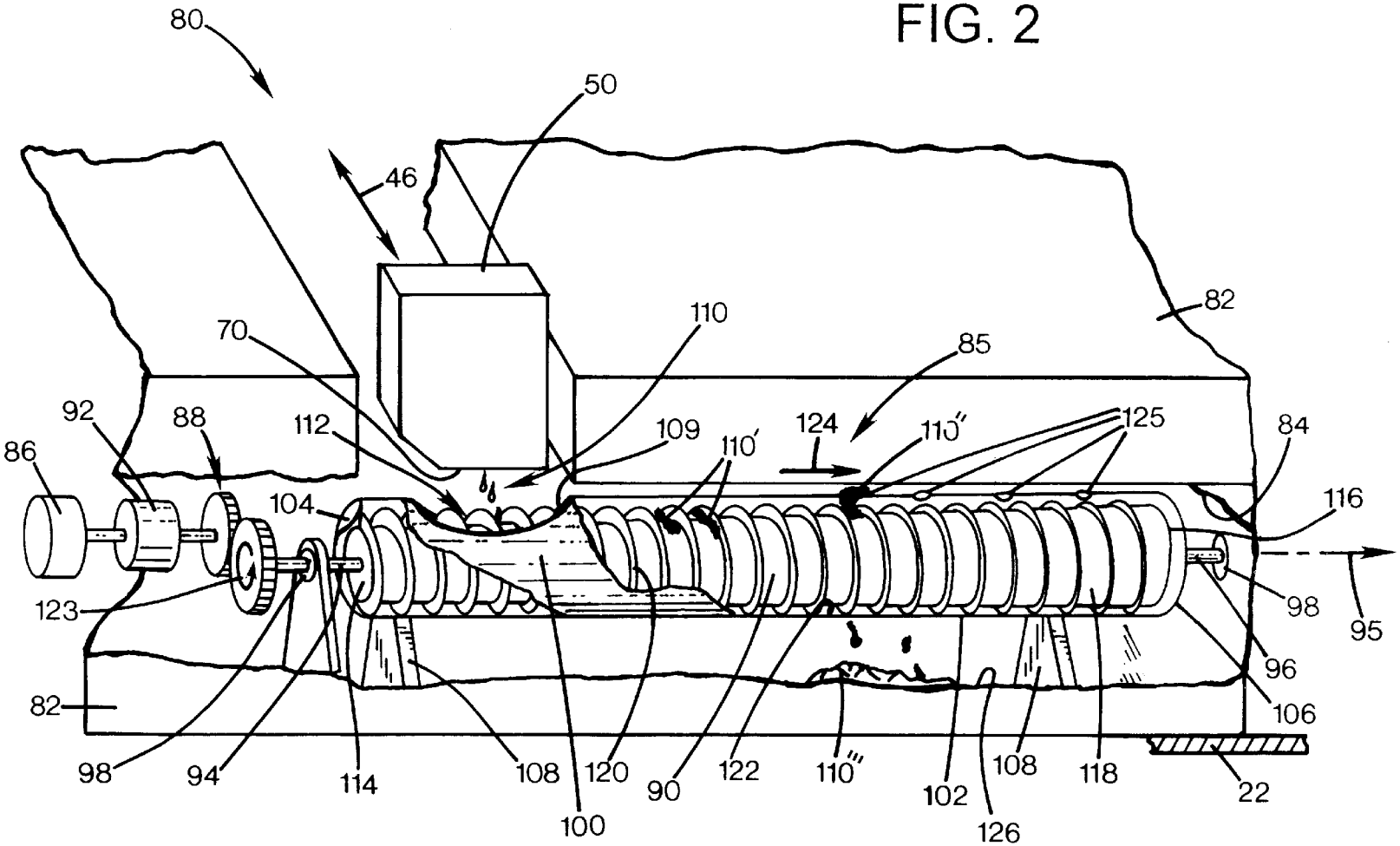
FIG. 2 is a partially schematic, perspective view of the service station of FIG. 1.
Figure 3:
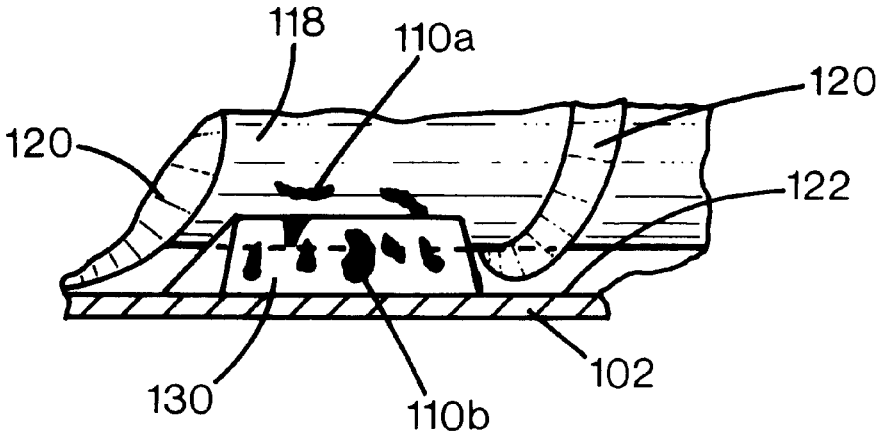
FIG. 3 is an enlarged perspective view of an shaft cleaner portion of the tapered screw spittoon system of FIG. 1.

In the printzone 25, the media sheet 34 receives ink from an inkjet cartridge, such as a black ink cartridge 50 and three monochrome color ink cartridges 52, 54 and 56, shown schematically in FIG. 2. The cartridges 50–56 are also often called "pens" by those in the art. The black ink pen 50 is illustrated herein as containing a pigment-based ink. While the illustrated color pens 52–56 each contain a dye-based ink of the colors cyan, magenta and yellow, respectively. In FIGS. 3 and 4, the cyan pen 52 is also indicated by the letter "C," the magenta pen 54 by the letter "M," the yellow pen 56 by the letter "Y," and the black pen 50 by the letter "K," which are standard color designations in the field of inkjet printing. It is apparent that other types of inks may also be used in pens 50–56, such as paraffin-based inks, as well as hybrid or composite inks having both dye and pigment characteristics.

The illustrated pens 50–56 each include small reservoirs for storing a supply of ink in what is known as an "off-axis" ink delivery system, which is in contrast to a replaceable cartridge system where each pen has a reservoir that carries the entire ink supply as the printhead reciprocates over the printzone 25 along the scan axis 46, which is parallel to the X-axis of the XYZ coordinate system shown in FIG. 1. Hence, the replaceable cartridge system may be considered as an "on-axis" system, whereas systems which store the main ink supply at a stationary location remote from the printzone scanning axis are called "off-axis" systems. In the illustrated off-axis printer 20, ink of each color for each printhead is delivered via a conduit or tubing system 58 from a group of main stationary reservoirs 60, 62, 64 and 66 to the on-board reservoirs of pens 50, 52, 54 and 56, respectively. The stationary or main reservoirs 60–66 are replaceable ink supplies stored in a receptacle 68 supported by the printer chassis 22. Each of pens 50, 52, 54 and 56 have printheads 70, 72, 74 and 76, respectively, which selectively eject ink to from an image on a sheet of media in the printzone 25. The concepts disclosed herein for cleaning the printheads 70–76 apply equally to the totally replaceable inkjet cartridges, as well as to the illustrated off-axis semi-permanent or permanent printheads, although the greatest benefits of the illustrated system may be realized in an off-axis system where extended printhead life is particularly desirable.

The printheads 70, 72, 74 and 76 each have an orifice plate with a plurality of nozzles formed therethrough in a manner well known to those skilled in the art. The nozzles of each printhead 70–76 are typically formed in at least one, but typically two linear arrays along the orifice plate. Thus, the term "linear" as used herein may be interpreted as "nearly linear" or substantially linear, and may include nozzle arrangements slightly offset from one another, for example, in a zigzag arrangement. Each linear array is typically aligned in a longitudinal direction perpendicular to the scanning axis 46 and parallel with the Y-axis of FIG. 1, with the length of each array determining the maximum image swath for a single pass of the printhead. The illustrated printheads 70–76 are thermal inkjet printheads, although other types of printheads may be used, such as piezoelectric printheads. The thermal printheads 70–76 typically include a plurality of resistors which are associated with the nozzles. Upon energizing a selected resistor, a bubble of gas is formed which ejects a droplet of ink from the nozzle and onto a sheet of paper in the printzone 25 under the nozzle. The printhead resistors are selectively energized in response to firing command control signals delivered by a multi-conductor strip 78 from the controller 40 to the printhead carriage 45.

Tapered Screw Spittoon System
For Handling Waste Inkjet Ink

FIG. 2 illustrates one form of a service station 80 constructed in accordance with the present invention for servicing the black and color printheads 70–76. The service station 80 has a frame 82, a portion of which is shown in FIG. 2. The service station frame 82 is supported by the printer chassis 22 in the servicing region 48 within the printer casing 24. The service station 80 supports a variety of printhead servicing appliances (not shown) such as printhead caps and printhead wipers, which are not the subject of this invention. The service station frame 82 defines a waste ink storage container or spittoon chamber 84. The service station 80 has a tapered screw spittoon system 85, constructed in accordance with the present invention for handling waste inkjet ink deposited in particular by the black printhead 70. The spittoon chamber 84 forms a portion of the spittoon system 85 for permanent storage of the ink residue.

The service station 80 may also include a conventional absorbent color ink spittoon (not shown) to receive ink spit from the color printheads 72–76. Alternatively, three additional tapered screw spittoon systems may be installed in the service station 80 to individually service each of the color printheads 72–76, or a single additional tapered screw spittoon system may be used to service all of the color printheads 72–76. In the illustrated embodiment, the color inks are dye-based inks, which do not form the same type of tar-like residue after spitting as does the black pigment-based ink, so a conventional absorbent color ink spittoon provides adequate service to the color printheads 72–76.

The service station 80 has an activating device, such as a motor 86 that is coupled to drive a gear assembly 88, which in turn is coupled to drive an active member, such as a spiral member or in the illustrated embodiment, a tapered screw member 90 of the tapered screw spittoon system 85. The motor 86 rotates in response to control signals received from the printer controller 40. The motor 86 may also be used to move other servicing components, such as caps and wipers (not shown) between rest and servicing positions, in which case, the service station 80 may include an optional clutch mechanism 92 to selectively couple and de-couple the screw member 85 from the motor 86 and/or gear assembly 88. The tapered screw 90 has a front spindle 94 located along a longitudinal axis 95 of the screw, and a rear spindle 96 also located along axis 95. The longitudinal axis 95 is parallel with the Y-axis of the XYZ coordinate system shown in FIG. 1, although in other implementations, it may be more practical to orient the longitudinal orientation of the tapered screw spittoon system 85 in another direction. The front and rear spindles 94, 96 may be supported by a pair of conventional bearing or bushings 98 supported by the service station frame 84.

The tapered screw spittoon system 85 also has a container or reservoir, such as a cylindrical barrel member 100 with a cylindrical wall 102 surrounding the tapered screw 90. The barrel 100 has a longitudinal axis which coincides with the screw longitudinal axis 95. The barrel 100 also has a front wall 104 and a rear wall 106, through which the front and rear spindles 94 and 96, respectively, extend. Indeed, the bearings 98 may be supported by the barrel walls 104 and 106, rather than by the service station frame 82. The barrel 100 is mounted in a fixed location to the service station frame 82, such as by a pair of upright supports 108. Alternatively, the barrel 100 may be integrally molded into the service station frame 82. For instance, a portion of the barrel, such as a lower half, may be molded integrally with the service station frame 82, allowing the tapered screw 90 to be lowered into the barrel lower half, with an upper half of the barrel then being snap-fit, bonded or otherwise secured to the lower half. When assembled, the barrel side wall 102 defines a spittoon entranceway 109 which receives ink 110 purged or "spit" from the printhead 70. This waste ink 110 travels through the barrel entranceway 109, and lands on a spit region 112 of the tapered screw 90.

The spit region 112 is located toward a front or proximate end 114 of the screw 90, while the rear spindle 96 projects from a rear or distal end 116 of the tapered screw. The tapered screw 90 has a tapered shaft 118 from which a helical or spiral thread member 120 projects. Preferably, the tapered screw 85 is constructed of an ink-resistant, non-wetting material with dimensional stability, such as a nylon material, a glass fiber filled nylon material, a Teflon or other low-friction coated material, or other materials which are compatible with the type(s) of inks dispensed by printheads 70–76. The barrel 100 may be constructed of the same material, or of other ink-compatible materials. The shaft 118 is tapered, here having a narrower diameter at the front end 114, and gradually expanding in diameter along its length to a widest diameter as the rear end 116. Thus, the shaft 118 has a truncated conical shape, with the screw 90 and barrel 100 defining a void therebetween which gradually decreases in cross sectional volume from the front end 104 of the reservoir toward the rear end 106 of the reservoir.

As mentioned above, the illustrated barrel 100 has a cylindrical side wall 102, with the barrel defining a cylindrical collection chamber or a screw chamber 122 therein. As shown in FIG. 2, the screw thread 120 changes in height as it spirals down along the widening shaft. Near the front end 114, the thread 120 is at its greatest height, with the thread 120 gradually reducing in height as it approaches the rear end 116, where the thread 120 is the shortest. This height reduction of thread 120 coincides with the gradual increase in the diameter of shaft 118 toward the rear end 116, allowing the outermost edge of the thread 120 to have a cylindrical diameter, just slightly less than the interior diameter of the barrel chamber 122 Tapered screw systems have been used in the past for moving granular material, such as farm grains, as well as for moving thick liquid materials, such as molten plastics in injection molding machines; however, to the best of the inventor's knowledge, no such tapered screw system has ever been proposed for handling waste inkjet ink in a spittoon system onboard an inkjet printing mechanism.

Rotation of the screw 90 by the motor 86 and gear assembly 88 in the direction of arrow 123 causes the thread 120 to push the waste ink 110 along the interior of the barrel side wall 102 to move the ink toward the rear end 116 of the screw, as shown for ink 110' traveling in the direction of arrow 124. The speed of rotation may vary depending upon the particular implementation, but speeds on the order of about 1–20 revolutions per minute are believed to be suitable. Rotational speed variation may be preferred in some implementations to achieve different results. Preferably, a waiting period is inserted between the spitting step and the beginning of rotation of the screw member 90. During this waiting period, the ink 110 is allowed to remain in the spit region 112 at least long enough to allow the volatile components of the ink to evaporate, because there is a greater exposure to the ambient air in the spit region 112 than along the remaining interior portion of the barrel 100, such as at the location of waste ink 110'. Also, delaying rotation of screw 90 allows the ink residue to build-up so the accumulated residue pushes previously spit residue, accumulated along the interior of the barrel 100, along the screw 90. After evaporation of the volatile components, the remaining residue of ink solids, such as residue 110' in FIG. 2, begins to dry to a tar-like consistency.

Preferably, the barrel side wall 102 defines a group of ink residue exit holes therethrough, such as holes 125. In FIG. 2, we see the waste ink 110" being squeezed and compacted by the widening diameter of shaft 118 as it traverses toward the rear end 116 of the screw 90. Together, the tapered screw 90 the barrel 100 function as a compaction member, with the volume-decreasing void between the screw and barrel being used to compact the ink residue during transport from the spit region 112 to the exit holes 125. Upon reaching the first exit hole 125, a portion of the ink residue 110" is shown being extruded through hole 125, to leave barrel 100, and eventually fall to the floor of the spittoon chamber 84, as shown for waste ink 110'". in FIG. 2. The non-compressible nature of this highly viscous residue 110" allows the residue to be forced out through holes 125 as additional residue is compressed into the narrowing void between the tapered screw 90 and the wall of the barrel screw chamber 122. The waste ink 110'" is then stored at a remote location 126 in the spittoon chamber 84, that is, at location 126 which is remote from the spit region 112 at entranceway 109. The remainder of the ink residue 110" may be similarly extruded through the remaining exit holes 125 as the residue is moved further down the barrel by the thread 120 of the rotating screw 90. This process of moving ink residue from the spit region 112 to the remote location 126 in the spittoon chamber 84 for permanent storage provides volumetric efficiency that handles the black ink residue accumulation over the lifespan of the printer 20.

As shown in FIG. 3, the tapered screw spittoon system 85 may include at least one optional shaft cleaner, scraper or auger member 130. Preferably, at least one auger 130 projects from the interior of the cylindrical side wall 102 and into the screw chamber 122. One particularly useful location for auger 130 is at the base of the barrel 100 under the spit region 112, to scrape off waste ink **110*a* which may have hardened on the shaft 90. The residue removed by auger 130 from the shaft 90 is deposited under the force of gravity inside the chamber 122 as residue 110*b*. This residue 110*b* accumulates until eventually reaching a great enough amount to be carried away by the flights of the thread 120 for compaction and expulsion as described above for residue 110" and 110**'".

It is apparent that a variety of modifications may be made to the tapered screw spittoon system 85 while still implementing the core principles illustrated herein. For instance, rather than a single helical flight for thread 120, two or more threads 120 may wind around the tapered shaft 90. Alternatively, the thread 120 may be segmented rather than being a single flight. Furthermore, in some implementations, the shaft 90 may not be a continuous tapering member, but the shaft may have a non-tapered section, such as at the spit region 112 adjacent the shaft cleaning auger 130. Other such modifications may be made without departing from the inventive concepts herein which are only shown by way of illustration with respect to the drawings and related discussion.

Conclusion

Thus, a variety of advantages are realized using the tapered screw spittoon system 85. For instance, the tapered screw spittoon system 85 advantageously moves the waste ink residue 110 accumulated during the nozzle spitting process from the spit region 112 underneath the printheads 70–76 to a remote region 126 for permanent storage. Particularly when printing with pigment based inks, such as the illustrated black ink dispensed by printhead 70, after the volatile components evaporate, the remaining ink solids form a highly viscous, tar-like residue 110' which is efficiently removed from the spit region along the flights of the tapered screw thread 120. During the spiraling travel of the ink residue 110' in the direction of arrow 124, the increasing diameter taper of the screw shaft 118 compresses the residue 110' into a compact bundle, squeezing out space-consuming air from the residue for more efficient space utilization during permanent storage. Another advantage of the spittoon system 85 is the low-profile of the service station 80, leading to a more compact inkjet printing unit 20 for consumers.

I claim:

1. A spittoon system for handling ink residue spit from an inkjet printhead in an inkjet printing mechanism, comprising:

a reservoir having a first end and an opposing second end, with the reservoir defining an entranceway opening adjacent to the first end for receiving ink residue spit from the inkjet printhead, with the reservoir also defining an ink exit opening remote from the first end;

a tapered screw member rotatably mounted inside the reservoir, with the tapered screw member having a tapered shaft which increases in diameter along the length of the screw member from the first end of the reservoir toward the second end of the reservoir; and a rotating device which selectively rotates the tapered screw member to transport ink residue received through the entranceway opening and to squeeze the ink residue out of the reservoir through the ink exit opening.

2. A spittoon system according to claim 1 further including a storage container defining a chamber in communication with the ink exit opening of the reservoir to receive and store therein the ink residue squeezed through the ink exit opening.

3. A spittoon system according to claim 2 wherein the reservoir has a cylindrical interior wall and the reservoir is supported inside the storage container.

4. A spittoon system according to claim 1 wherein the reservoir also defines a second ink exit opening located between said ink exit opening and the second end.

5. A spittoon system according to claim 1 wherein the reservoir has a cylindrical interior wall and the tapered screw member is mounted therein for rotation around a first axis, and the reservoir has a longitudinal axis that coincides with the first axis.

6. A spittoon system according to claim 1 further including a shaft cleaner member projecting from the reservoir to remove ink residue from a portion of the tapered shaft.

7. A spittoon system for handling ink residue spit from an inkjet printhead in an inkjet printing mechanism, comprising:

a reservoir having a wall with an interior surface that defines a collection chamber having a first end and an opposing second end, with the reservoir defining an entranceway opening adjacent to the first end for receiving ink residue spit from the inkjet printhead, with the reservoir also defining an ink exit opening remote from the first end;

an active member moveably mounted inside the reservoir to define a void between the active member and the interior surface of the reservoir wall, with void decreasing in cross sectional volume from the first end of the reservoir toward the second end of the reservoir; and an activator device which selectively moves the active member to transport ink residue received through the entranceway opening through the void to the ink exit opening, with the ink residue being compacted during transport through the decreasing in cross sectional volume of the void and squeezed out of the reservoir through the ink exit opening.

8. A spittoon system according to claim 7 wherein:

the active member comprises a tapered screw member which is rotationally supported within the reservoir collection chamber, with the tapered screw member having a tapered shaft which increases in diameter along the length of the screw member from the first end of the reservoir toward the second end of the reservoir;

the activator device comprises a motor coupled to selectively rotate the tapered screw member; and the reservoir wall interior surface has a cylindrical shape.

9. A spittoon system according to claim 7 further including a shaft cleaner member projecting from the interior surface of the reservoir wall into the collection chamber to remove ink residue from a portion of the active member.

10. A spittoon system according to claim 9 wherein the shaft cleaner is located adjacent the entranceway opening of the reservoir.

11. A method of purging ink residue from an inkjet printhead in an inkjet printing mechanism, comprising the steps of:

spitting ink residue from the printhead onto a spit region of a compaction member located inside a reservoir which defines an entranceway opening through which said ink residue is spit and an ink exit opening at a second location;

transporting the ink residue from the spit region to said second location;

during the transporting step, compacting the ink residue with the compaction member; and expelling the compacted ink residue into a storage container from the second location by extruding the compacted ink residue through the ink exit opening and into the storage container.

12. A method according to claim 11 wherein:

the reservoir defines a second ink exit opening; and the expelling step comprises the step of extruding a portion of the compacted ink residue through the second ink exit opening and into the storage container.

13. A method according to claim 11 wherein:

the compaction member comprises an active member and a reservoir having a wall with an interior surface that defines a collection chamber within which the active member is moveably supported;

the transporting step comprises the step of moving the active member; and the compacting step comprises the step of squeezing the ink residue between the interior surface of the reservoir wall and the active member by moving the active member.

14. A method according to claim 11 further including the step of removing ink residue from a portion of the compaction member.

15. A method of purging ink residue from an inkjet printhead in an inkjet printing mechanism, comprising the steps of:

spitting ink residue from the printhead onto a spit region of a compaction member comprising an active member and a reservoir, with the reservoir having a wall with an interior surface that defines a collection chamber within which the active member is moveably supported;

transporting the ink residue from the spit region to a second location by moving the active member;

during the transporting step, compacting the ink residue with the compaction member by squeezing the ink residue between the interior surface of the reservoir wall and the active member while moving the active member;

expelling the compacted ink residue into a storage container from the second location;

wherein the active member comprises a tapered screw member which is rotationally supported within the reservoir collection chamber;

wherein the transporting step comprises the step of rotating the tapered screw member; and wherein the compacting step comprises the step of squeezing the ink residue between the interior surface of the reservoir wall and the tapered screw member by rotating the tapered screw member.

16. A method according to claim 15 wherein:

the reservoir wall defines an entranceway opening and an ink exit opening at said second location;

the spitting step comprises spitting the ink residue through the entranceway opening; and the expelling step comprises the step of extruding the compacted ink residue through the ink exit opening and into the storage container by rotating the tapered screw member.

17. A method according to claim 15 further including the step of scraping ink residue from a portion of the tapered screw member.

18. A method of purging ink residue from an inkjet printhead in an inkjet printing mechanism, comprising the steps of:

spitting ink residue from the printhead onto a spit region of a spiral member rotationally mounted within a reservoir;

transporting the spit ink residue from the spit region to a second location along a spiral path within the reservoir; and expelling the ink residue into a storage container from the second location.

19. A method according to claim 18 wherein:

the spiral member comprises a tapered screw member and the reservoir has a wall with a cylindrical interior surface, with the reservoir wall defining an entranceway opening and an ink exit opening at said second location;

the spitting step comprises spitting the ink residue through the entranceway opening;

the expelling step comprises the step of extruding the compacted ink residue through the ink exit opening and into the storage container; and before the expelling step, the method further includes the step of the squeezing the ink residue between the cylindrical interior surface of the reservoir wall and the tapered screw member during the transporting step.

20. A method according to claim 18 further including the step of scraping ink residue from a portion of the spiral member.

21. An inkjet printing mechanism, comprising:

an inkjet printhead;

a carriage that carries the printhead through a printzone for printing and to a servicing region for printhead servicing; and a spittoon system located in the servicing region to receive ink residue spit from the printhead, with the spittoon system comprising:

a reservoir having a first end and an opposing second end, with the reservoir defining an entranceway opening adjacent to the first end for receiving ink residue spit from the inkjet printhead, with the reservoir also defining an ink exit opening remote from the first end;

a tapered screw member rotatably mounted inside the reservoir, with the tapered screw member having a tapered shaft which increases in diameter along the length of the screw member from the first end of the reservoir toward the second end of the reservoir; and a rotating device which selectively rotates the tapered screw member to move ink residue received through the entranceway opening and to squeeze the ink residue out of the reservoir through the ink exit opening.

22. An inkjet printing mechanism according to claim 21 further including a storage container defining a chamber in communication with the ink exit opening of the reservoir to receive and store therein the ink residue squeezed through the ink exit opening, wherein the reservoir has a cylindrical interior wall and the reservoir is supported inside the storage container.

23. An inkjet printing mechanism according to claim 22 wherein:

the reservoir also defines a second ink exit opening located between said ink exit opening and the second end; and the tapered screw member is mounted inside the reservoir for rotation around a first axis, and the reservoir has a longitudinal axis that coincides with the first axis.

24. An inkjet printing mechanism according to claim 21 further including a shaft cleaner member projecting from the reservoir to remove ink residue from a portion of the tapered shaft.

25. A spittoon system according to claim 24 wherein the shaft cleaner is located adjacent the entranceway opening of the reservoir.

* * * * *

UNITED STATES PATENT AND TRADEMARK OFFICE

CERTIFICATE OF CORRECTION

PATENT NO. : 6,213,583 B1
DATED : April 10, 2001
INVENTOR(S) : Therien

It is certified that error appears in the above-identified patent and that said Letters Patent is hereby corrected as shown below:

Title page,
Item [54], delete "SPITTOOM" and insert therefor -- SPITTOON --.

Column 7,
Line 64, after "122" insert -- . --.

Column 8,
Line 34, after "90" insert -- and --.

Signed and Sealed this

Eleventh Day of March, 2003

JAMES E. ROGAN
*Director of the United States Patent and Trademark Office*